US005706540A

United States Patent [19]

Niewiarowski

[11] Patent Number: 5,706,540

[45] Date of Patent: Jan. 13, 1998

[54] AUTOMATIC CLEANERS FOR SWEEPING AND CLEANING SWIMMING POOLS

[75] Inventor: Weislaw Niewiarowski, Perth, Australia

[73] Assignee: Kreepy Krauly USA, Inc., Sunrise, Fla.

[21] Appl. No.: 675,639

[22] Filed: Jul. 3, 1996

[30] Foreign Application Priority Data

Jul. 6, 1995 [AU] Australia ..... PN-3987/95

[51] Int. Cl.[6] ..... E04H 4/16

[52] U.S. Cl. ..... 15/1.7; 137/561 R; 285/132

[58] Field of Search ..... 15/1.7; 137/561 A, 137/561 R, 602; 285/132, 136, 273, 274

[56] References Cited

U.S. PATENT DOCUMENTS 4,935,980 6/1990 Leginus ..... 15/1.7

5,014,382 5/1991 Kallenbach ..... 15/1.7

5,033,148 7/1991 Chauvier ..... 15/1.7

5,337,433 8/1994 Gould ..... 15/1.7

*Primary Examiner*—David Scherbel

*Assistant Examiner*—Randall Chin

*Attorney, Agent, or Firm*—Dorsey & Whitney LLP

[57] ABSTRACT

An automatic pool cleaner including a body, an elongated member connected to the body, the elongated member having two fluid flow paths, a valve mounted for alternately directing the flow of fluid between the fluid flow paths, the upper ends of the two fluid flow paths being connected together by an arcuate passage in a first plane substantially co-planar with the elongated member, and the arcuate passage connected to at least one arcuate outlet passage in a second plane at an angle to the first plane.

6 Claims, 2 Drawing Sheets

AUTOMATIC CLEANERS FOR SWEEPING AND CLEANING SWIMMING POOLS

REFERENCE TO RELATED APPLICATIONS

This application claims the priority of Australian Application No. PN. 3987/95 filed Jul. 7, 1995, which is incorporated herein by reference.

BACKGROUND OF THE INVENTION

This innovation relates to automatic pool cleaners of the type adapted to be connected through a flexible hose to the inlet of a pump circulating water through the pool. One such cleaner is marketed throughout Australia and other countries under the trade mark "Kreepy Krauly." One version of the "Kreepy Krauly" cleaner is described in Australian Patent Specification No. 505209.

Such automatic pool cleaners comprise a body having an inlet, a flexible seal mounted on the body to bear against the surface of the wall or floor of the pool, a flip-flop valve member capable of moving back and forth between two extreme positions for controlling the flow of water through a body (and in so doing produces a water hammer effect which acts on the cleaner to propel it across the surface), and an elongated member inclined upwardly from the body connecting the body to the inlet end of a flexible hose, said elongated member having two passages or being formed of two parallel tubes through which the water flows alternately.

SUMMARY OF THE INVENTION

It has been found that as the water discharges from the upper end of one passage or tube it tends to exert a jetting effect on the water in the other passage or tube and affects the efficiency of the cleaner. It has been found that the efficiency of the cleaner can be improved if the upper ends of the two passages or tubes are connected by an arcuate passage substantially co-planar with two passages or tubes and the arcuate passage is connected to at least one arcuate outlet passage in a plane at an angle to said first mentioned plane.

Thus the present invention resides in an automatic pool cleaner of the type described characterized in that the upper ends of the two passages or tubes of the elongated member are connected together by an arcuate passage substantially co-planar with the elongated member and the arcuate passage is connected to at least one arcuate outlet passage in a plane at an angle to said first mentioned plane.

Preferably the plane in which the outlet passage is located is at right angles to the plane in which the elongated member is located.

The invention will be better understood by reference to the following description when read in conjunction with the accompanying drawings.

DETAILED DESCRIPTION OF THE INVENTION

Figure 1:
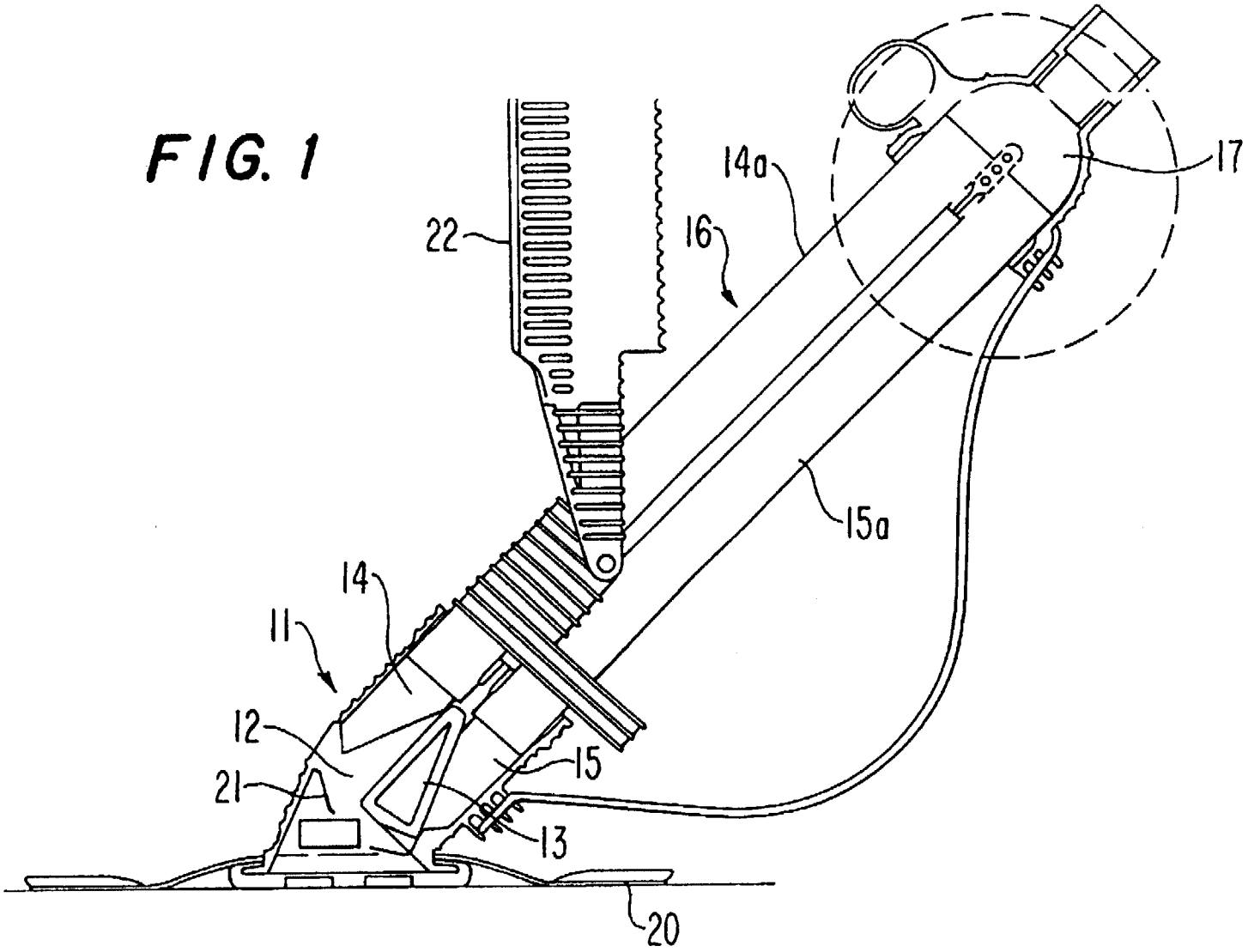
FIG. 1 is a sectional view of a known automatic pool cleaner.

Referring to FIG. 1 of the drawings of the body 11 of the cleaner is constructed substantially as described in Australian Patent Specification No. 50509 and has a valve chamber 12 in which a wedge shaped hammer valve member 13 is housed so that it can move back and forth with a flip-flop action about an axis coinciding with the apex of the valve member from a position in which it bears against and closes the inlet end of a first passage or fluid flow path 14 to a position in which it bears against the inlet end and closes a second passage or fluid flow path 15 also formed in the body. The movement of the valve member from one position to the other produces a water hammer effect which acts on the cleaner to propel it across the surface to be cleaned. An elongated member 16 connected to the cleaner body has an axis in a first plane and is formed by two lengths of plastic tube 14*a* and 15*a* which, in effect, are extensions of the passages 14 and 15, respectively. The upper ends of the tubes 14*a* and 15*a* are connection to a chamber 17 the upper end of which is pivotally connected to the inlet end of a flexible hose (not shown) by means of a swivel coupling. The base of the cleaner body is provided with laterally projected wings and a pleated flexible seal 20 which bears on the surface to be cleaned. It is also provided with one or more inlets while the valve chamber may be provided with a baffle 21. A dive float assembly 22 is pivotally mounted on the body of the cleaner.

With the valve member in the position shown in FIG. 1 the water passing up through tube 14*a* enters the chamber 17 with a jetting action and this causes the water in the tube 15*a* to tend to move upwardly and thus reduce the pressure acting on the valve member.

Figure 3:
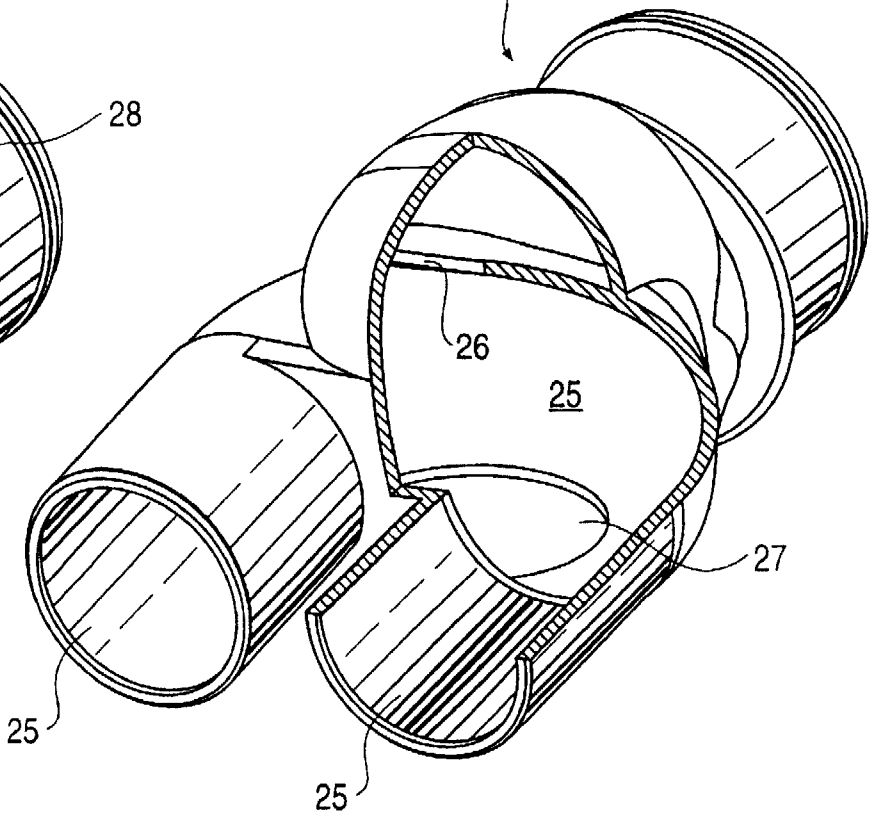
FIG. 3 is a repetition of FIG. 2 partially sectioned.
Figure 2:
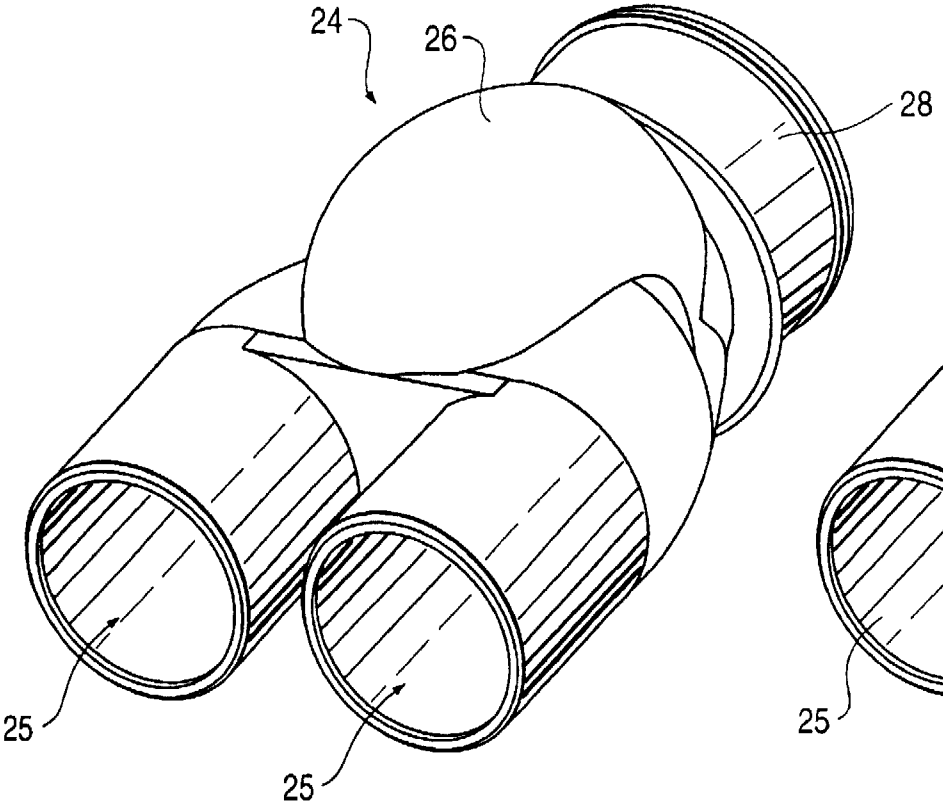
FIG. 2 is a perspective view of the upper portion (enclosed in the circle) of the elongated member of the cleaner of FIG. 1 modified in accordance with the invention.

If, in accordance with the invention, the circled portion at the top of FIG. 1 is replaced by the construction shown in FIGS. 2 & 3 a more efficient cleaner is provided and it is possible to reduce the diameter of the tubes 14*a* and 15*a*. The construction shown in FIGS. 2 & 3 comprises a member 24 having an arcuate passage 25 which is co-planar with the first plane (of the elongated member formed by tubes 14*a* and 15*a*). Each end of the arcuate passage 25 is adapted to be connected to the upper ends of tubes 14*a* and 15*a* respectively. Arcuate outlet passages 26 and 27 are connected to the arcuate passage 25 on opposite sides thereof and lead to the swivel coupling 28 through which the inlet end of the hose is connected to the elongated member. By bleeding off the water from the arcuate passage 25 through the lateral arcuate passages 26 and/or 27, any jetting action of the water as it enters the area of the arcuate passage 25 between the inlet ends of the passages 26 and 27 is substantially eliminated. Furthermore, the water passing from the tube 14*a* through the passage 25 and into the tube 15*a* applies additional pressure to the flip-flop valve member to move it to its opposite position. Thus it is possible to reduce the diameter of the tubes 14*a* and 15*a* so that less water has to be pumped to operate the cleaner which is less noisy.

The foregoing is a complete description of the present invention. Various changes and modifications can be made without departing from the spirit and scope of the present invention. The invention, therefore, should be limited only by the following claims.

What is claimed is:

1. An automatic pool cleaner comprising:

a body;

an elongated member having an axis, said elongated member being connected to said body, and having two fluid flow paths therein;

a valve mounted relative to said elongated member for alternately directing the flow of fluid between the two fluid flow paths;

an arcuate passage;

the upper ends of the two fluid flow paths being connected together by said arcuate passage in a first plane substantially co-planar with the axis of the elongated member; and said arcuate passage connected to at least one arcuate outlet passage in a second plane at an angle to the first plane.

2. An automatic pool cleaner as claimed in claim 1 wherein the at least one arcuate outlet passage is located in a plane substantially at a right angle to the plane in which the flow paths of the elongated member are located.

3. An automatic pool cleaner as claimed in claim 1, wherein two arcuate outlet passages are provided, oppositely disposed on opposite sides of the arcuate passage.

4. An automatic pool cleaner as claimed in claim 2, wherein two arcuate outlet passages are provided, oppositely disposed on opposite sides of the arcuate passage.

5. An automatic pool cleaner as claimed in claim 1, wherein the two fluid flow paths are passages in said elongated member.

6. An automatic pool cleaner as claimed in claim 1, wherein the two fluid flow paths are tubes in said elongated member.

* * * * *